US006762731B1

(12) United States Patent
Chou

(10) Patent No.: US 6,762,731 B1
(45) Date of Patent: Jul. 13, 2004

(54) DISH ANTENNA ROTATION APPARATUS

(75) Inventor: Wen-Pin Chou, Hsinchu (TW)

(73) Assignee: Microelectronics Technology Inc., Hsinchu (TW)

( * ) Notice: Subject to any disclaimer, the term of this patent is extended or adjusted under 35 U.S.C. 154(b) by 1 day.

(21) Appl. No.: 10/352,484

(22) Filed: Jan. 28, 2003

(51) Int. Cl.[7] ..... H01Q 3/02
(52) U.S. Cl. ..... 343/882; 343/880; 343/892
(58) Field of Search ..... 343/840, 880, 343/882, 878, 879, 892

(56) References Cited

U.S. PATENT DOCUMENTS 4,495,706 A * 1/1985 Kaminski ..... 33/333
6,081,240 A * 6/2000 Hemmingsen, II ..... 343/760
6,188,372 B1 * 2/2001 Jackson et al. ..... 343/882
6,445,361 B2 9/2002 Liu et al. ..... 343/882
6,559,806 B1 * 5/2003 Watson ..... 343/766
6,697,026 B1 * 2/2004 Hemmingsen, II ..... 343/760

* cited by examiner

*Primary Examiner*—Shih-Chao Chen
(74) *Attorney, Agent, or Firm*—Seyfarth Shaw LLP

(57) ABSTRACT

The present invention discloses a rotation apparatus of a dish antenna for adjusting a dish antenna to direct to a satellite. The rotation apparatus of the dish antenna includes an elevation bracket and a dish bracket. The elevation bracket includes two wings, a base and a cover, where the two wings are approximately parallel, the base connects the bottoms of the two wings and is approximately perpendicularly to them, and the cover is approximately perpendicularly connected to the front end of the base. The dish bracket includes a top plate and an arc plate, where the top plate includes at least one concentric groove, and the arc plate having at least one arc groove is approximately perpendicularly connected to top plate.

17 Claims, 4 Drawing Sheets

DISH ANTENNA ROTATION APPARATUS

BACKGROUND OF THE INVENTION (A) Field of the Invention

The present invention is related to a rotation apparatus of a dish antenna. More specifically, the rotation apparatus of the dish antenna is capable of adjusting the elevation angle and the rotation angle.

(B) Description of Related Art

The satellite television system employs a dish antenna to collect satellite signals, and the signals are then reflected to low noise block down converters (LNB) equipped at the focus of the dish antenna for amplifying the signals and reducing its frequency down to around 1 GHz, i.e., the signals of radio frequency are transformed to be of intermediate frequency. The adjusted signals are transmitted to an indoor TV channel selector by a cable to select the signals of a desired channel, and the selected signals are then amplified and modulated to recover into video and audio signals for TV watching.

Dish antenna is a high directional receiving device which has to precisely direct to satellites on the orbit of 36,000 kilometers altitude. For example, if a dish antenna of a 180 cm diameter shifts 2 cm in transverse, or 3 cm in vertical, the signals will become weak or even disappeared. Therefore, the precision of the direction of the dish antenna is very important.

If a dish antenna has to direct to a plurality of synchronous satellites, the direction of the dish antenna has to be adjustable, which is usually done by adjusting the elevation angle and the rotation angle.

In accordance with the patent U.S. Pat. No. 6,445,361 B2, Liu discloses a rotation apparatus of a dish antenna including a dish bracket and an elevation bracket. The elevation bracket includes a central axle hole and three holes which surround the central axle hole. The central axle hole and the three holes respectively align with a concentric axle center and three circular grooves of the dish bracket to secure the dish bracket and the elevation bracket. After the dish antenna is rotated to a selected position, the three holes are secured to the circular grooves by three screws.

Originally, the elevation bracket is constituted by two individual components; one object of this patent is to integrate the individual components as a whole to enhance the rigidity. Generally, a satellite receiving system has to withstand 60 m/s of wind pressure. However, because the wind direction changes with respect to different seasons and weathers, a dish antenna has to withstand side wind in addition to the wind in a normal direction. Liu only utilizes three screws to secure the dish bracket and the elevation bracket, which may be insufficient to resist a large shear force.

SUMMARY OF THE INVENTION

The object of the present invention is to provide a high strength rotation apparatus of a dish antenna for enhancing the stability and obtaining better signal-receiving and signal-transmitting performance.

The rotation apparatus of the dish antenna of the present invention for adjusting a dish antenna to direct to a satellite comprises an elevation bracket and a dish bracket. The elevation bracket comprises two wings, a base and a cover, the two wing being approximately parallel, and each wing having a groove for adjusting the elevation angle of the dish antenna, the base connecting the bottoms of the two wings and being approximately parallel to them, and also being provided with at least a first fastener, and the cover being in the form of an arc and approximately perpendicularly connected to the base, and also having at least a second fastener. The dish bracket comprises a top plate and an arc plate, the top plate comprising at least one concentric groove for allowing the first fastener to slide therein, and the arc plate being approximately perpendicularly connected to top plate and having at least one arc groove for allowing the second fastener to slide therein. The dish antenna is adjusted to direct to the satellite by respectively sliding the first fastener and the second fastener in the concentric groove and the arc groove, and then the elevation bracket and the dish bracket are assembled by the first fastener and the second fastener.

DETAILED DESCRIPTION OF THE INVENTION

Figure 1:
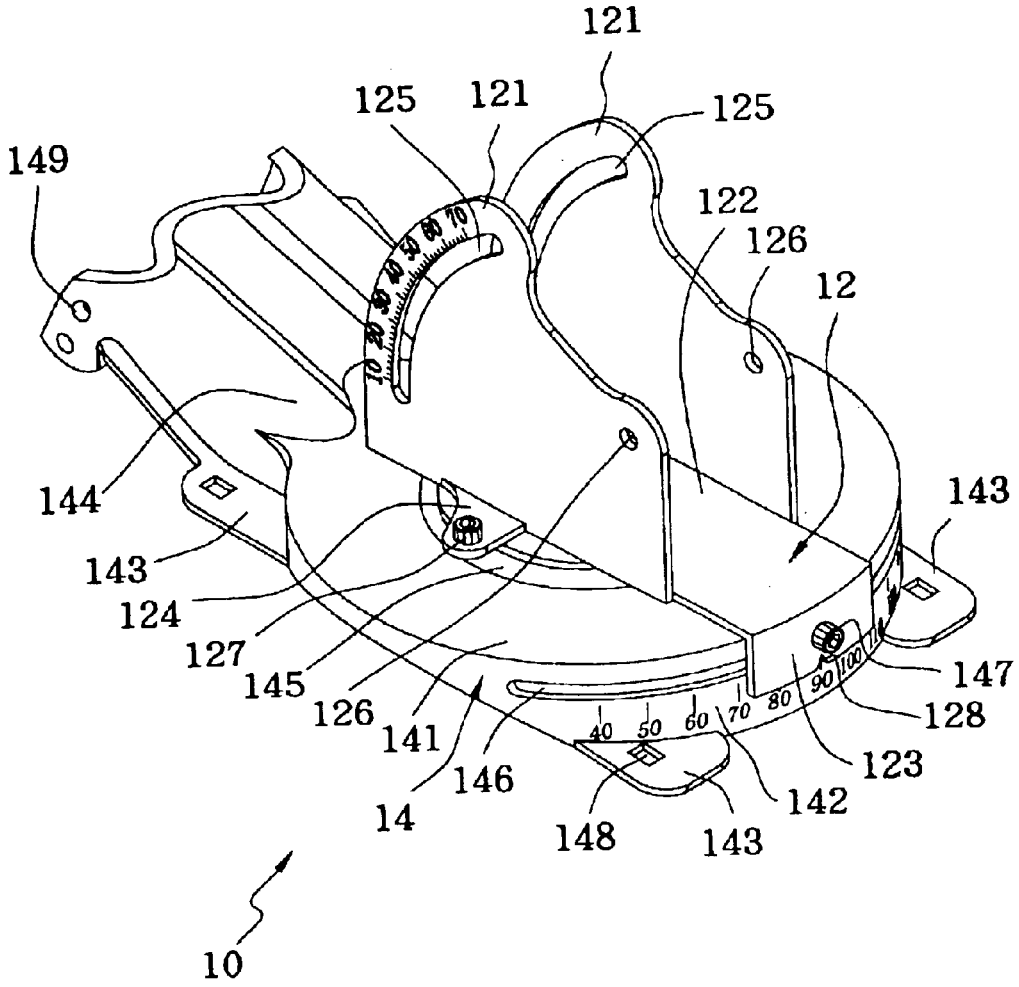
FIG. 1 illustrates the rotation apparatus of the dish antenna of the present invention.
Figure 2:
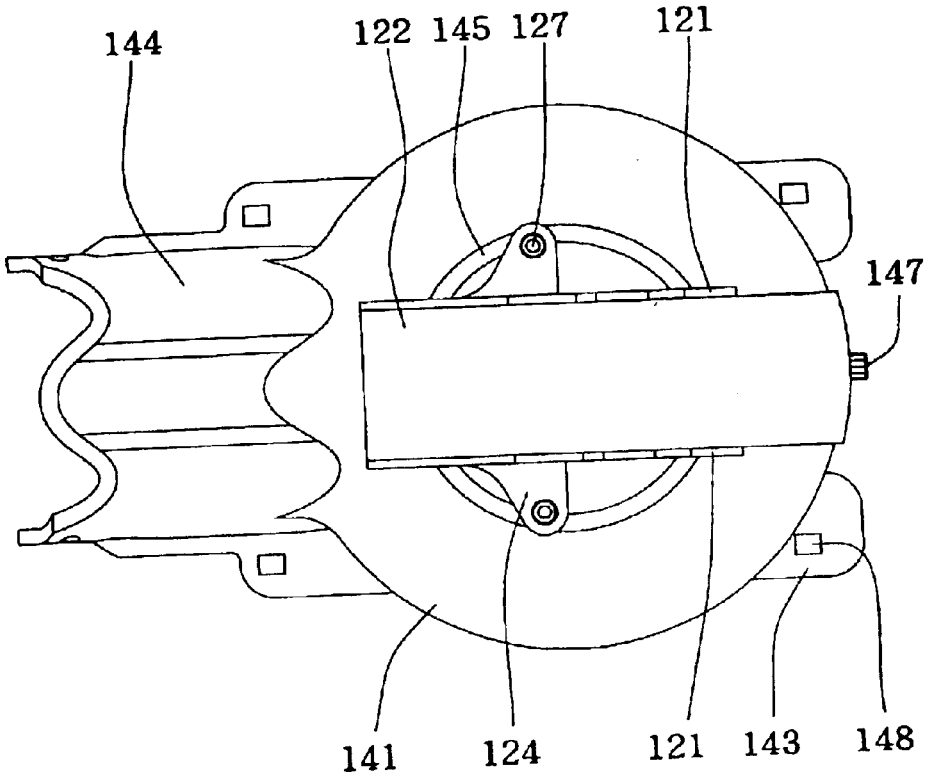
FIG. 2 illustrates the top view of the rotation apparatus of the dish antenna of the present invention.
Figure 3:
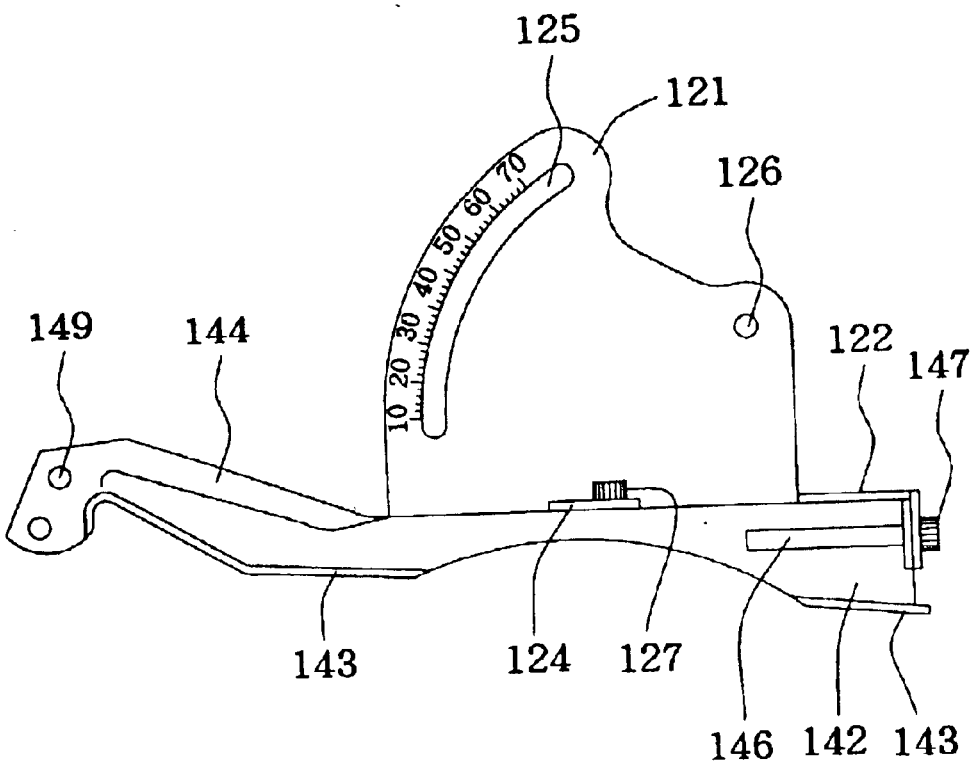
FIG. 3 illustrates the side view of the rotation apparatus of the dish antenna of the present invention.

FIG. 1 illustrates a rotation apparatus of a dish antenna 10 in accordance with the present invention, which is capable of adjusting the elevation angle and the rotation angle, and the top view and the side view are respectively shown in FIG. 2 and FIG. 3. The rotation apparatus of the dish antenna 10 includes an elevation bracket 12 and a dish bracket 14. The elevation bracket 12 is mainly constituted of two wings 121, a base 122 and a cover 123, where the two wings 121 are approximately parallel, each wing 121 having a groove 125 marked a ruler for indicating the elevation angle of the dish antenna and a hole 126 for being fixed to a Support (not shown), and the base 122 connects the bottoms of the two wings 121 and is approximately perpendicular to them for increasing the strength of the elevation bracket 12. Further more, the base 122 includes two lugs 124 which outwardly protrude the planes of the wings 121, and each lug 124 is provided with a bolt 127. The cover 123 is approximately perpendicularly connected to the front end of the base 122, and each cover 123 is provided with a bolt 147. The cover 123 may be shaped as an arc, and its radius has to comply with the shape of the dish bracket 14 for assembly.

The dish bracket 14 includes a top plate 141, an arc plate 142, four extending plate 143 and a connecting bar 144, the top plate 141 including two circular grooves 145 which allow the bolts 127 to slide therein, the arc plate 142 including an arc groove 146 marked a ruler, and the arc plate 142 having a radius which is approximately equivalent to that of the cover 123 for being snugly against the cover 123 and allowing the bolt 147 to slide inside the arc groove 146, each extending plate 143 having a hole 148 for fixing the dish antenna, and the connecting bar 144 including four holes 149 for being connected to an LNB support beam(not shown).

In addition, the cover 123 may have a V-shaped notch 128 to indicate the rotation angle based on the ruler on (he arc plate 142. The dish antenna can be adjusted to direct to a satellite by respectively sliding the bolts 127 and 147 inside the circular grooves 145 and the arc groove 146, and then the elevation bracket 12 and the dish bracket 14 are secured by the bolts 127 and 147.

Figure 4:
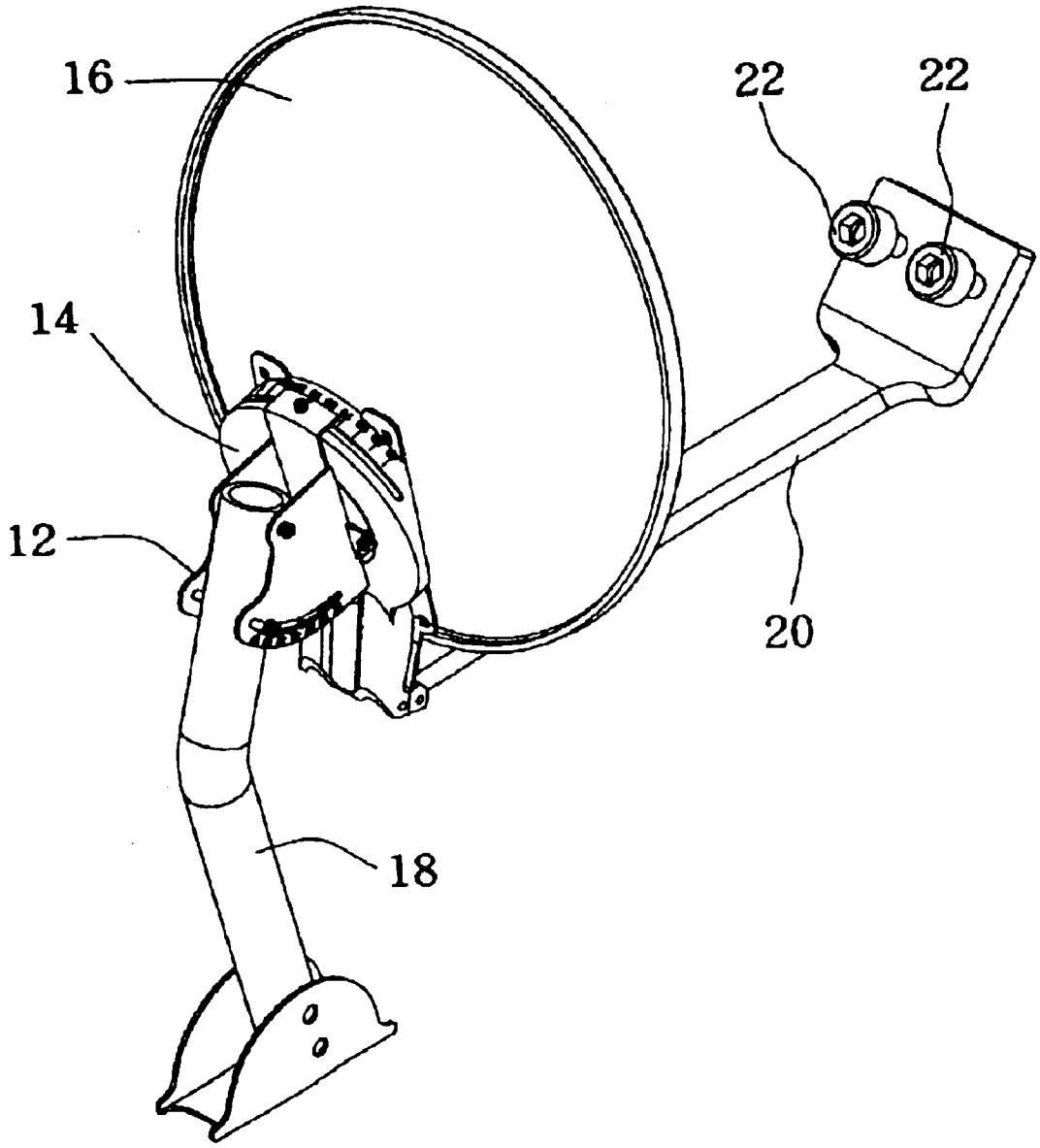
FIG. 4 illustrates the application of the dish antenna apparatus of the present invention.

Referring to FIG. 4, a dish antenna 16 is connected to the dish bracket 14, the elevation bracket 12 is fixed to a support 18, and two LNBs 22 are supported by a beam 20 connected to the dish bracket 14.

The base 122 and the cover 123 of the elevation bracket 12 respectively abut against the top plate 141 and the arc plate 142 of the dish bracket 14, so part of shear force borne by the screws mentioned in the above related art is transformed into tension or compression on the bolt 147 equipped on the cover 123. Therefore, the present invention can provide a more rigid and more stable structure than a traditionally designed one.

The bolts 127 and 147 can be substituted by other fasteners, e.g., a clamp, so long as they can provide substantially same function. The ruler can be marked on the top plate 141 to also indicate the rotation angle. The two wings 121 and the base 122 of the elevation bracket 12 can be integrally formed as a whole, and the dish bracket 14 can be integrally formed as well to strengthen the structure.

The above-described embodiment of the present invention are intended to be illustratively only. Numerous alternative embodiments may be devised by those skilled in the art without departing from the scope of the following claims.

What is claimed is:

1. A rotation apparatus of a dish antenna for adjusting the dish antenna to direct to a satellite, the rotation apparatus comprising:

an elevation bracket, including:

two wings, each wing having a groove for adjusting an elevation angle of the dish antenna;

a base connecting the two wings, the base being approximately perpendicular to the two wings and having at least one first fastener; and a cover connected to the base in an approximately perpendicular manner, the cover being in the form of an arc and having at least one second fastener; and a dish bracket, including:

a top plate having at least one concentric groove for allowing the first fastener to slide therein; and an arc plate connected to tile top plate in an approximately perpendicular manner, the arc plate having at least an arc groove for allowing the second fastener to slide therein.

2. The rotation apparatus of the dish antenna in accordance with claim 1, further comprising a plurality of extending plates connected to the arc plate, and each extending plate comprising a hole for fixing the dish antenna.

3. The rotation apparatus of the dish antenna in accordance with claim 1, wherein the radius of the arc plate is approximately equivalent to that of the cover.

4. The rotation apparatus of the dish antenna in accordance with claim 1, wherein the base comprises two lugs for equipping the first fastener, and the two lugs respectively outwardly protrude the two wings.

5. The rotation apparatus of the dish antenna in accordance with claim 1, wherein the cover has a V-shaped notch for indicating the rotation angle.

6. The rotation apparatus of the dish antenna in accordance with claim 1, wherein a ruler is marked along the arc groove of the arc plate.

7. The rotation apparatus of the dish antenna in accordance with claim 1, wherein a ruler is marked along the concentric groove of the top plate.

8. The rotation apparatus of the dish antenna in accordance with claim 1, wherein each wing further comprises a hole for being fixed to a support.

9. The rotation apparatus of the dish antenna in accordance with claim 1, wherein the dish bracket further comprises a connecting bar to support at least one low noise block down converter.

10. The rotation apparatus of the dish antenna in accordance with claim 1, wherein the two wings and the base are formed integrally.

11. The rotation apparatus of the dish antenna in accordance with claim 1, wherein dish bracket is formed integrally.

12. The rotation apparatus of the dish antenna in accordance with claim 1, wherein the first fastener and the second fastener are bolts.

13. A rotation apparatus of a dish antenna for adjusting the dish antenna to direct to a satellite, comprising:

an elevation bracket including two approximately parallel wings, a base and a cover, the base being approximately perpendicular to the two wings, and the cover being approximately perpendicularly connected to a front end of the base; and a dish bracket including a top plate and an arc plate, the arc plate being approximately perpendicular to the top plate, the top plate and the arc plate respectively snuggling against the base and the cover;

wherein the dish antenna is adjusted to direct to the satellite by respectively rotating the top plate and the arc plate along the base and the cover.

14. The rotation apparatus of the dish antenna in accordance with claim 13, wherein the top plate comprises at least one concentric groove for allowing a first fastener of the base to slide therein, and the arc plate includes at least one arc groove for allowing a second fastener to slide therein.

15. The rotation apparatus of the dish antenna in accordance with claim 13, wherein the radius of the arc plate is approximately equivalent to that of the cover.

16. The rotation apparatus of the dish antenna in accordance with claim 14, wherein the base comprises two lugs for equipping the first fastener, and the two lugs respectively outwardly protrude the two wings.

17. The rotation apparatus of the dish antenna in accordance with claim 14, wherein the first fastener and the second fastener are bolts.

* * * * *